United States Patent [19]

Madaus et al.

[11] Patent Number: 4,979,840

[45] Date of Patent: Dec. 25, 1990

[54] FOUNTAIN PEN WITH CORRECTION-CARTRIDGE RECEIVER

[75] Inventors: Batto Madaus, Burgwedel; Bruno Künzler, Pattensen, both of Fed. Rep. of Germany

[73] Assignee: Pelikan Aktiengesellschaft, Hanover, Fed. Rep. of Germany

[21] Appl. No.: 448,007

[22] Filed: Dec. 7, 1989

[30] Foreign Application Priority Data

Dec. 7, 1988 [DE] Fed. Rep. of Germany ..... 3841201
Jun. 24, 1989 [DE] Fed. Rep. of Germany ..... 3920773

[51] Int. Cl.[5] ..... B43K 9/00; B43K 29/02; B43K 27/08; B05G 17/00

[52] U.S. Cl. ..... 401/202; 401/17; 401/192

[58] Field of Search ..... 401/202, 213, 17, 244, 401/262, 243, 192, 23

[56] References Cited

U.S. PATENT DOCUMENTS 2,453,491 11/1948 Cardin ..... 401/244
4,558,966 12/1985 Mikuteit ..... 401/202
4,627,757 12/1986 Manusch ..... 401/213
4,759,651 7/1988 Manusch ..... 401/202
4,844,642 7/1989 Inaba ..... 401/202
4,865,479 9/1989 Doll ..... 401/17

FOREIGN PATENT DOCUMENTS 1283703 11/1968 Fed. Rep. of Germany .
2441610 12/1976 Fed. Rep. of Germany .
2620503 11/1977 Fed. Rep. of Germany .
8109560 10/1981 Fed. Rep. of Germany .
8232781 6/1983 Fed. Rep. of Germany .
3538077 12/1986 Fed. Rep. of Germany .
3702785 8/1987 Fed. Rep. of Germany .

*Primary Examiner*—Richard J. Johnson
*Attorney, Agent, or Firm*—Herbert Dubno

[57] ABSTRACT

A cartridge-type fountain pen is formed at its rear end with a reserve compartment for receiving a reserve ink cartridge or a liquid applicator reservoir whose applicator is designed to project through an opening end of the rear end of the barrel. A second cap can be pressed on this rear end and has a rear cap member spring biased into engagement with the reservoir and whose position is visible through a window in an outer cap member of this second cap so that the user can ascertain whether or not the liquid applicator is in place within the reserve compartment.

9 Claims, 2 Drawing Sheets

FOUNTAIN PEN WITH CORRECTION-CARTRIDGE RECEIVER

FIELD OF THE INVENTION

Our present invention relates to a fountain pen and, more particularly, to a cartridge-type fountain pen. Specifically, the invention relates to a cartridge-type fountain pen having a first cap which can be removed to expose the writing tip or nib and a second cap at the opposite end of the fountain pen barrel which can be removed to expose the applicator tip of a correction-liquid cartridge or liquid like reservoir. In this type of fountain pen, a reserve space is provided at the rear end of the barrel, i.e. the end opposite that provided with the writing tip, in which a container or reservior of a correction liquid can be received and the rear end of the barrel may have an opening through which the applicator tip can project for use when the second cap is removed.

BACKGROUND OF THE INVENTION

A cartridge-type fountain pen of the above described general type is described in German Patent Document DE-AS 24 41 610. This pen has the advantage that, apart from having a conventional ink writing element, e.g. a writing tip or nib, it can be provided at the opposite end with an applicator, for example, a capillary body, fiber tip, ball, tube or the like, from which another medium can be applied to the substrate (e.g. a paper sheet). For example, the reservoir or container for this other medium may form part of a correction system enabling a correcting liquid to be applied to the paper. A correcting liquid can be, for example, an agent which is capable of removing the color of previously applied ink, i.e. a bleaching substance, a substance capable of transforming the dyestuff of an ink into a colorless substance, or some other so-called "ink eradicator".

In general, when the ink eradicator liquid is to be dispensed from the second reservoir, it is provided with a fiber or felt tip as an applicator.

Of course, in place of the ink eradicator reservoir, a reserve cartridge with writing ink can be accommodated in the reserve space if this is desired. The reserve space and the reservoir, as a result, generally have shapes which are intended to match the configuration of the ink cartridge used for the fountain pen so that both the eradicator-liquid reservoir and a reserve cartridge can be interchangeably and selectively received in the reserve compartment.

With this conventional fountain pen, however, it has been found to be disadvantageous that the second cap is applied to a neck-shaped portion of the eradicator fluid reservoir so as to be held directly by the latter. This means that a relatively small diameter portion serves to hold the cap and limits the dimensions and shape of the applicator element for the eradicator liquid.

When, in place of the correction liquid reservoir, a reserve ink cartridge is provided in the reserve compartment, the open end of the housing or barrel is not closed and the appearance of the fountain pen is detrimentally affected.

Furthermore, in this system, the end of the ink cartridge which must communicate with the nib during later use tends to become contaminated and there is a danger that the coupling end of the reserve ink cartridge will become so soiled that it cannot be properly received in the nib portion of the fountain pen.

Finally, there is a danger that contamination of this end of the reserve ink cartridge may result in leaking of the ink during use or that leakage may occur because of damage to the coupling end of the cartridge.

The fountain pen described in German Patent Document 36 42 283 has a replaceable ink eradicator part located at the end of the fountain pen barrel opposite that provided with the writing tip. The ink eradicator cartridge in this case has a tip which can receive a sealing cap which is form fittingly and friction fittingly received on this tip.

The sealing cap and the eradicator cartridge end of the tip are formed respectively with identical outer screw threads and the open end of the barrel housing and an end cap cooperating therewith have respective inner threads cooperating with the outer threads. In this construction, the tip and the sealing cap can be screwed into the barrel housing or the end cap so that the end cap is connected with the barrel by this ink eradicator unit.

In this construction, the applicator region can have a larger diameter and enables closure of the housing or barrel by an end cap.

However, the requirement for numerous screw threads makes the system expensive and, in addition, this system cannot accommodate a reserve ink cartridge.

German Patent 35 38 077, corresponding to U.S. Pat. No. 4,759,651, describes a cap for the writing tip of a fountain pen which comprises a sleeve adapted to be pressed over the barrel and in which a sealing unit is provided for the writing tip.

In the region of the writing tip, this fountain pen comprises an annular bulge with which the inner bore of the sealing unit can come into sealing engagement.

A second annular bulge serves for fastening the sleeve on the barrel.

Upon application of the cap to the writing end of the instrument, the sealing member is shifted into the sleeve as the latter is placed upon the barrel, thereby enabling the first bulge to be pressed into the sealing unit and thereafter enabling the sleeve to engage the second bulge. In this writing instrument the sealing unit also serves as a signal element which can project beyond the opposite end of the sleeve from that having the opening receiving the barrel, to indicate the fact that the cap has been properly seated on the tip.

OBJECTS OF THE INVENTION

It is, therefore, the principal object of the present invention to provide a cartridge-type fountain pen which has the advantages of the fountain pen first mentioned above but without the drawbacks thereof.

Another object of this invention is to provide a cartridge-type fountain pen which has a rear end opening for a reserve compartment, enabling selective accommodation therein of a correction-liquid cartridge and its applicator tip, and a reserve cartridge, but which enables the end to be closed regardless of the contents of the reserve compartment.

Yet another object of the invention is to provide a fountain pen which eliminates disadvantages of prior art constrictions and has a reserve compartment which can be closed but wherein it can be readily ascertained from the exterior whether or not the reserve compartment contains a reservoir with an applicator tip.

SUMMARY OF THE INVENTION

These objects and others which will become apparent hereinafter are attained, in accordance with the invention in a writing instrument, especially a cartridge-type fountain pen, which comprises:

A fountain-pen barrel formed at one end with a writing tip;

a first cap removably fitting onto the one end and enclosing the writing tip, the barrel being provided with a cartridge chamber adjacent the writing tip for replaceably receiving an ink cartridge communicating with the writing tip, the barrel being further formed with a reserve compartment between the ink cartridge and an opposite end of the barrel and receiving selectively a reserve ink cartridge and a liquid applicator, the opposite end of the barrel being stepped down in cross section and being provided with an opening through which a tip of the liquid applicator can project; and a second cap fitted removable onto the other end of the barrel and including:

an outer cap member detachably engageable with the barrel at the other end, an inner cap member received in the outer cap member and axially shiftable therein, the inner cap member being dimensioned to engage and be arrested by a portion of the liquid applicator projecting through the opening upon fitting of the second cap onto the barrel, a spring braced between the members for urging the inner cap member toward an open end of the second cap and stressed upon movement of the inner cap member more deeply into the outer cap member upon fitting of the second cap onto the barrel and engagement of the inner cap member with the portion, and means forming a window in the outer cap member through which a position of the inner cap member is visible to indicate to a user the presence or absence of the liquid applicator in the reserve compartment by the position of the inner cap member; and cooperating formations on the outer cap member at the open end and on the stepped down cross section of the barrel for releasably securing the second cap on the barrel.

According to the invention, therefore, the second cap comprises an axially movable inner cap member which can be shifted against the force of a spring and which can be pressed over the applicator element of a correction liquid reservoir to seal directly against the latter.

When the second cap is placed onto the rear end of the barrel, the applicator tip of this reservoir, which projects through the rear opening of the barrel, presses the inner cap member further into the outer cap member of the second cap and allows the axial position of the inner cap member to be viewed through a window in the outer cap member in at least one of its positions. The outer cap member, in turn, can engage on a stepped end of the barrel by a detent or other form-locking means.

The cartridge-type fountain pen of the invention thus has the advantage that the rear end of the barrel or housing can be closed by a second cap seating onto the barrel whether or not a correction liquid reservoir or reserve ink cartridge is received in the reserve compartment. The cap can esthetically conform to the housing and advantageously has its outer surface flush with the outer surface of the housing so that a uniform and harmonious appearance of the fountain pen is insured.

Since the second cap engages the barrel directly and the stepped portion of the latter can define the wall of the reserve compartment, no additional free space is required between the barrel and the correction liquid reservoir. As a consequence, the applicator can have a comparatively large diameter.

Finally, with the system of the invention, even with the second cap in its closed position, the user can readily discern through the window whether or not the reserve compartment contains a reservoir containing, for example, the correction liquid.

According to a feature of the invention, the inner cap is held by a reserve ink cartridge in the reserve compartment in an intermediate position between the position of the inner cap corresponding to an empty reserve compartment and the position of the inner cap when a correction liquid reservoir is provided in the barrel. As a consequence, the user can also detect from the exterior and through the window whether the reserve compartment is empty or it contains either a reserve cartridge or a correction liquid reservoir and whichever of the latter two may be contained in the reserve compartment.

According to a further feature of the invention, the second cap is connected by a bayonet connection with the barrel and the spring which is braced against the inner cap and which holds the inner cap against the reservoir or the barrel, serves to retain the second cap in its locked position. This construction facilitates removal and application of the second cap, automatically locks the latter into its tightened state on the barrel and permits a relatively substantial force to be applied to the inner cap so that effective sealing between the inner cap and the reservoir is insured. To form the bayonet connection, according to the invention, the rear end of the barrel can have at least one lateral projection and the second cap can have at least one inwardly projecting rib formed on the inner surface of the bore of the outer cap member so that the pin can engage behind the rib upon a partial rotation of the cap. The projection or pin can, moreover, engage in a lateral recess formed in the rib to index the cap in its locked position on the barrel.

The stepped end of the barrel housing can be formed, in the reserve compartment, with a shoulder against which the reservoir with its applicator element or a reserve ink cartridge can engage in the axial direction. Furthermore, at the open end of the inner cap member, a sealing element can be formed or provided which cooperates with a setting surface on the reservoir.

The second cap preferably comprises a cup-shaped cap bottom of transparent material and an opaque or nontransparent cap sleeve which is fixed to the cap and between them forms the window. According to the invention, the cap between has an end edge forming an abutment or seat for the spring which is braced against the inner cap. The replaceable reservoir with its applicator can, like the ink cartridges, be marketed separately from the fountain pen itself so that it can be thrown away and replaced by a new correcting liquid cartridge when its contents are exhausted.

For sale and prior to use, the reservoir can be packaged with a covering cap which, after the reservoir is inserted in the reserve compartment, is no longer necessary and thus can be discarded before such insertion.

While reference has been made herein to a correction liquid cartridge or to a reservoir containing correction liquid as defined above, it will be apparent that the liquid contained in the reservoir can be any other liquid which may be conveniently applied utilizing the fountain pen. For example, it may be a marking ink, another writing liquid or ink, or even liquid paste or glue which is to be applied by the applicator tip.

When the liquid is an ink eradicator liquid, preferably it will be an ink decolorant which can remove the color of the ink applied by the fountain pen and enable overwriting with the same ink.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 4:
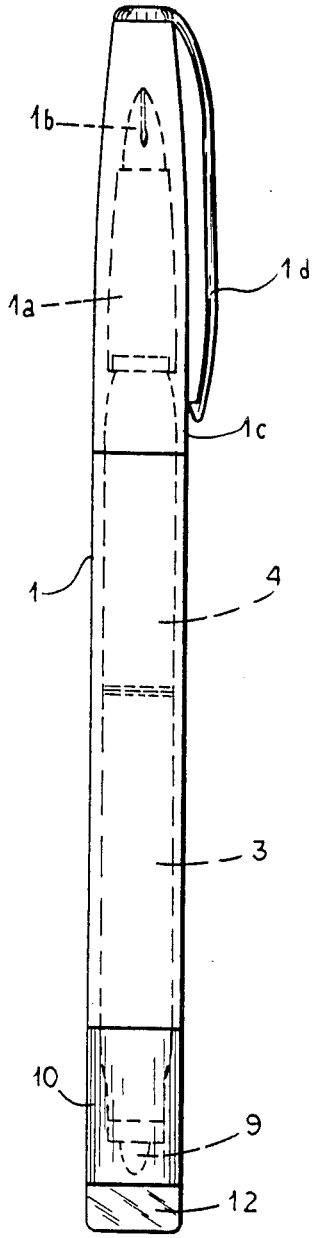
FIG. 4 is an elevational view of a fountain pen provided with the reserve compartment of the invention and adapted to receive either a reserve ink cartridge or a liquid applicator cartridge or reservoir according to the invention.

Referring first to FIG. 4, it can be seen that the fountain pen of the invention comprises a barrel 1 which is adapted to receive, in the usual manner, an ink cartridge 4 which can be connected to the tip 1*a* formed with a fountain pen nib 1*b*. The writing tip at the front end of the barrel 1 is enclosed by a cap 1*c* which can have a pocket clip 1*d*.

In the embodiment shown, the reserve compartment of the fountain pen receives the liquid container 3 having generally a shape corresponding to that of an ink cartridge, an applicator tip 9 and a second cap 10 as will be apparent hereinafter. The second cap 10 has a transparent cap bottom 12 through which the position of an inner cap member 14 can be discerned as will be apparent hereinafter.

Figure 1:
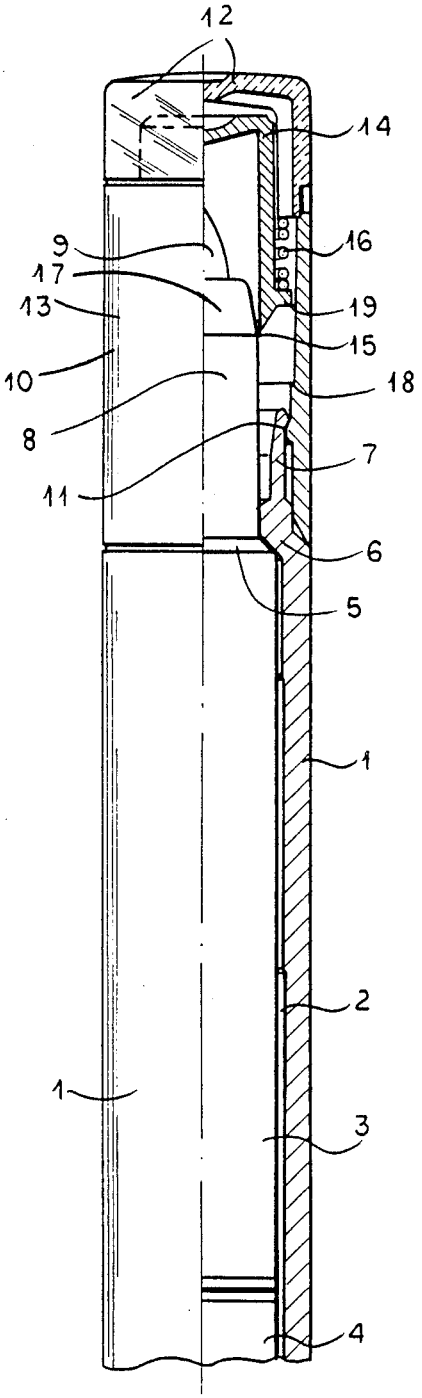
FIG. 1 is a partial cross section of a rear end of a cartridge fountain pen according to the invention.

Turning now to FIG. 1, in which only the rear part of the fountain pen has been illustrated, it will be apparent that the barrel 1, i.e. the fountain pen housing, is formed with a reserve compartment 3 containing a reservoir 3 for an ink eradicator solution.

The reservoir 3 is held in place by the ink cartridge 4 mounted in the usual manner in the front end of the barrel and is retained against a shoulder 6 of the barrel 1, having a shoulder 5 of the reservoir resting thereagainst. The shoulder 6 is formed by a constriction or collar 7 defining the rearwardly open end of the barrel 1.

A neck-forming section 8 of the reservoir 3 projects through the collar 7 and thus from the rear end of the barrel 1 and is formed at its extremity with a felt or fiber tip 9 for applying the correction liquid to the paper.

The second cap 10 can be pressed onto the collar and has an outer diameter equal to the outer diameter of the barrel so as to be flush therewith (see FIGS. 1 and 4).

Mutually engaging annular bulges 11 on the cap 10 and the collar 7 retain the cap 10 releasably on the collar but hold the cap fast thereon.

The cap 10 comprises the bottom part 12 of transparent material and a nontransparent or opaque sleeve part 13 connected nondetachably to the bottom part 12.

Within the cap 10 there is provided an inner cap member 14 which is pressed by a compression spring 16 against the reservoir 3.

More particularly, the inner cap 14 encloses the felt tip 9 and has a sealing lip 15 which can press against a seat surface 17 on the projecting portion 8 of the reservoir 3. In this manner, the inner cap 14 seals the felt tip 9 so that correction liquid cannot leak from the reservoir 3 and the felt tip will not dry up.

As FIG. 1 shows, the inner cap member 14 is held by the projecting portion 8 of the reservoir 3 against the force of spring 16 in an axially inner position within the cap 10 so that this inner cap member 14 is readily visible through the window formed by the bottom portion 12. If no reservoir 3 is received in the reserved compartment or the latter contains only a reserve ink cartridge, the inner cap 14 will be pressed by the spring 16 downwardly in the position shown in FIG. 1 until a shoulder in annular flange 19 of the inner cap comes to rest against a shoulder 18 in the cap bore. In this position, the inner cap 14 is no longer visible in the window formed by the bottom part 12 so that the user can readily discern that the reserve compartment does not contain the reservoir with correction liquid.

Figure 2:
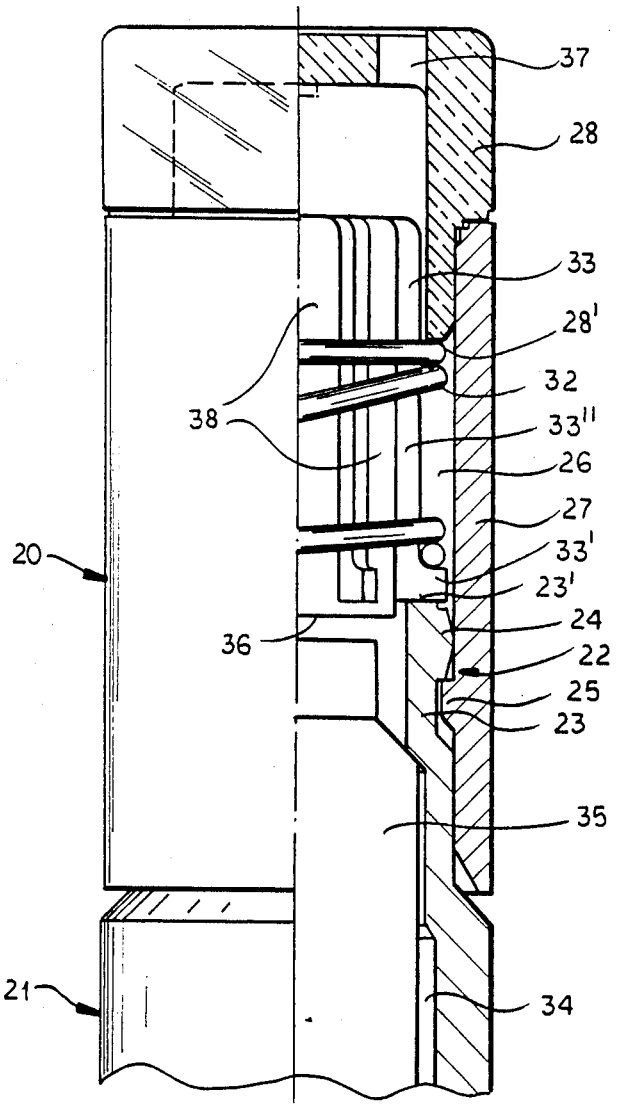
FIG. 2 is a view similar to FIG. 1 but drawn to a larger scale of another embodiment of the invention showing a reserve ink cartridge in the reserve compartment.

In the embodiment of FIG. 2, the second cap 20 is held onto the barrel 21 releasably by a bayonet connection 22. To form this bayonet connection, the constricted collar 23 of the barrel 21 is provided on its exterior with two opposing pins 24 which engage behind two ribs 25.

The ribs 25 project into the bore 26 of the sleeve 27 of the second cap. One of these ribs, shown in developed form, has been depicted in FIG. 3.

The sleeve 27 forms, together with the cup-shaped cap between 28, the cap 20.

Figure 3:
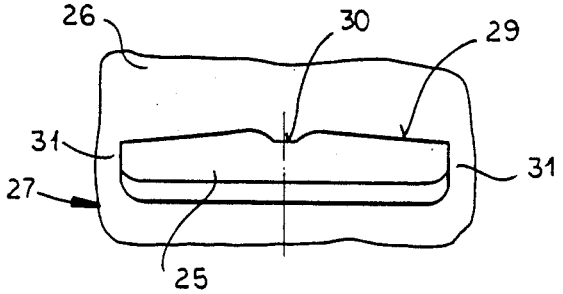
FIG. 3 is a developed view, drawn to a larger scale, of a rib formed in the bore of the second cap.

From FIG. 3 it will be apparent that each rib, e.g. the rib 25 visible in FIG. 3, has along a lateral surface 29 turned away from the open end of the sleeve and toward the cap between 28, a recess 30. Furthermore, the ribs are slightly inclined to opposite sides from this recess 30. Between the ribs 25 passages 31 are provided of a width greater than the diameters of the pins 24.

Upon positioning of the cap 20 on the barrel 21, the pins 24 pass through the passages 31 between the ribs 25 and the cap is then given an angular rotation of 90° relative to the barrel. The pins 24 ride along the flanges 29 until they drop into the recesses 30. During this operation, the pins 24 are held against the ribs 25 by the compression spring 32.

The compression spring 32 is disposed within the cap 20 and is braced at one end against an end edge 28′ of the cap bottom 28. At its other end, the compression spring 32 is braced against outwardly extending feet 33′ of axially extending ribs on the inner cap member 33. Consequently, upon application of the cap 30 to the barrel 21, and upon tightening of the bayonet connection at the collar 23, the cap 33 can rest against the end 23′ of this collar so that the spring 32 is compressed and the force of the spring 32 will retain the pins 24 in the recesses 30 preventing a spontaneous opening of the bayonet connection.

When the reserve compartment 34 contains only an ink cartridge 35, the inner cap member 33 will assume the position shown in FIG. 2 in which it is not visible through the window formed by the transparent material of the cap bottom 28.

When, however, the reserve compartment 34 receives a reservoir with an applicator as shown in FIG. 1, the inner cap 33 engages with its sealing edge 36 against the neck of that reservoir projecting through the collar 23 whereby the inner cap member 33 is forced more deeply into the cap 20 and becomes visible through the cap bottom 28.

To maintain the force holding the pins 24 against the ribs 25, it matters not whether the inner cap 33 engages the collar 23 directly or engages the reservoir which is braced against this collar 23. In the latter case, of course, a somewhat higher spring force is generated but because this force is relatively small in any event, the change in spring force has a negligible effect on the bayonet covering. To provide an emergency air passage in the cap in the event of swallowing thereof by a child, the cap bottom 28 is provided with an opening 37 and the inner cap member 33 is formed with ribs 33″ which define longitudinal grooves 38 between them. This allows the cap 20 to have throughgoing passages through which a sufficient quantity of air can be inhaled by the choking child.

We claim:

1. A cartridge-type fountain pen, comprising:

a fountain-pen barrel formed at one end with a writing tip;

a first cap removably fitting onto said one end and enclosing said writing tip, said barrel being provided with a cartridge chamber adjacent said writing tip for replaceably receiving an ink cartridge communicating with said writing tip, said barrel being further formed with a reserve compartment between said ink cartridge and an opposite end of said barrel and receiving selectively a reserve ink cartridge and a liquid applicator, said opposite end of said barrel being stepped down in cross section and being provided with an opening through which a tip of said liquid applicator can project; and a second cap removably fitting, onto said other end of said barrel and including:

an outer cap member detachably engageable with said barrel at said other end, an inner cap member received in said outer cap member and axially shiftable therein, said inner cap member being dimensioned to engage and be arrested by a portion of said liquid applicator projecting through said opening upon fitting of said second cap onto said barrel, a spring braced between said members for urging said inner cap member toward an open end of said second cap and stressed upon movement of said inner cap member more deeply into said outer cap member upon fitting of said second cap onto said barrel and engagement of said inner cap member with said portion, said spring bearing against an end edge of said outer cap member forming a seat for said spring, and means forming a window in said outer cap member through which a position of said inner cap member is visible to indicate to a user the presence or absence of said liquid applicator in said reserve compartment by the position of said inner cap member; and cooperating formations on said outer cap member at said open end and on at least one tongue-like lateral projection of the stepped down cross section of said barrel for releasably securing said second cap on said barrel.

2. The cartridge-type fountain pen defined in claim 1 wherein said inner cap member is arrested by said reserve ink cartridge in an intermediate position in said outer cap member between a position of said inner cap member corresponding to an empty reserve chamber and a position of said inner cap member in which said inner cap member is arrested by said liquid applicator, said intermediate position being indicated through said window by a corresponding color ring.

3. The cartridge-type fountain pen defined in claim 1 wherein said cooperating formations form a bayonet coupling between said barrel and said outer cap member which is locked by said spring upon engagement of said inner cap member with said liquid applicator when said applicator is present and with said barrel when said applicator is absent.

4. The cartridge-type fountain pen defined in claim 3 wherein said bayonet coupling is formed by said at least one lateral projection formed on said other end of said barrel, and at least one inwardly projecting rib formed on said outer cap member and engageable with said projection, said rib being formed with a detent recess receiving said projection.

5. The cartridge-type fountain pen defined in claim 1 wherein said inner cap member is formed with a sealing element cooperating with a seating surface of said liquid receptacle for sealing the tip of said liquid receptacle from drying out.

6. The cartridge-type fountain pen defined in claim 1 wherein said outer cap member is formed opposite said open end with a cup-shaped cap bottom composed of transparent material and has a cap sleeve of opaque material between said cap bottom and said open end fixed to said cap bottom.

7. The cartridge-type fountain pen defined in claim 6 wherein said cap bottom is formed with said end edge forming said seat for said spring, said spring bearing against said inner cap member.

8. The cartridge-type fountain pen defined in claim 1 wherein said outer cap member is formed with a vent opening at a bottom thereof opposite said open end and said inner cap member is formed with longitudinal grooves communicating between said vent opening and said open end to provide throughgoing air passages therebetween.

9. The cartridge-type fountain pen defined in claim 4 wherein said at least one inwardly projecting rib formed on said outer cap member is engageable with said at least one lateral projection upon rotation of said outer cap member on said barrel.

* * * * *